United States Patent [19]

Ota

[11] 4,130,608

[45] Dec. 19, 1978

[54] KICK-UP DEVICE FOR A SECONDARY THROTTLE VALVE IN A DIAPHRAGM-TYPE TWO BARREL CARBURETOR

[75] Inventor: Isamu Ota, Toyota, Japan

[73] Assignee: Toyota Jidosha Kogyo Kabushiki Kaisha, Toyota, Japan

[21] Appl. No.: 835,971

[22] Filed: Sep. 23, 1977

[30] Foreign Application Priority Data

May 19, 1977 [JP] Japan ..... 52-57915

[51] Int. Cl.[2] ..... F02M 11/02

[52] U.S. Cl. ..... 261/23 A; 261/41 C

[58] Field of Search ..... 261/41 C, 23 A

[56] References Cited

U.S. PATENT DOCUMENTS

| | | | |
|---|---|---|---|
| 2,749,100 | 6/1956 | Carlson | 261/41 C |
| 2,798,703 | 7/1957 | Carlson et al. | 261/41 C |
| 2,823,018 | 2/1958 | Glynn | 261/23 A |
| 2,837,322 | 6/1958 | Thome et al. | 261/41 C |
| 2,857,146 | 10/1958 | Carlson | 261/23 A |
| 3,328,007 | 6/1967 | Bickhaus et al. | 261/23 A |
| 3,682,149 | 8/1972 | Mitchell | 261/23 A |

*Primary Examiner*—Tim R. Miles

*Attorney, Agent, or Firm*—Stevens, Davis, Miller & Mosher

[57] ABSTRACT

A kick-up device for a secondary throttle valve in a diaphragm-type two barrel carburetor having a kick lever which is connected with a primary throttle shaft and has a cam portion and a follower lever which is connected with a secondary throttle shaft and has a cam follower portion wherein the cam and the cam follower portions are so designed that the secondary throttle valve begins to open when the primary throttle valve is opened beyond an intermediate angle such as 30°-50° and is finally opened up to a predetermined relatively small opening such as 5°-10° when the primary throttle valve is fully opened.

6 Claims, 7 Drawing Figures

KICK-UP DEVICE FOR A SECONDARY THROTTLE VALVE IN A DIAPHRAGM-TYPE TWO BARREL CARBURETOR

BACKGROUND OF THE INVENTION

The present invention relates to a two-barrel carburetor for use with automobile engines, and, more particularly, an improvement of a kick-up device for the secondary throttle valve of a diaphragm-type two barrel carburetor wherein the secondary throttle valve is opened by a diaphragm means actuated by venturi vacuum of the secondary venturi portion included in the secondary bore of the carburetor.

Modern automobile engines generally employ two-barrel carburetors having primary and secondary bores including primary and secondary venturi portions respectively, primary and secondary main fuel nozzles provided in the primary and secondary venturi portions respectively, primary and secondary throttle valves provided in the primary and secondary bores respectively, etc., wherein the primary throttle valve is directly operated to be opened or closed by the accelerator pedal via an accelerator linkage mechanism, while the secondary throttle valve is operated to be opened or closed by, in most cases, a diaphragm means, actuated by venturi vacuum of the primary venturi portion in a manner such that, when the air flow through the primary bore or venturi portion increases beyond a predetermined value, the secondary throttle valve is opened to put the secondary system into operation. Carburetors of this type are known as diaphragm-type two barrel carburetors.

Conventionally, a diaphragm-type two barrel carburetor incorporates a kick-up device for the secondary throttle valve which forcibly opens the second throttle valve by a very small opening such as 1° when the primary throttle valve is opened beyond a predetermined opening in order to prevent delaying of opening of the secondary throttle valve due to sticking of the secondary throttle valve to the wall of the secondary bore or frictional engagement which may occur therebetween, such delay otherwise being liable to occur, when the secondary throttle valve must be opened starting from its fully closed position by the diaphragm means.

Heretofore, these carburetors have been generally adjusted to produce fuel-air mixture of an economical, or lean, air/fuel ratio in medium load operation while producing a richer fuel-air mixture in high load operation by employing a power fuel system. However, in recent years, carburetors are often adjusted to produce a slightly richer fuel-air mixture than ever in order to compensate for a deterioration of combustibility of fuel-air mixture due to exhaust gas recirculation as well as in order to reduce generation of NOx. In most carburetors for automobile engines, the power fuel supply system is adjusted to produce fuel-air mixture of an optimum air/fuel ratio in ¾ load operation. Therefore, if the air/fuel ratio in low to medium load operation is adjusted to be slightly richer than the most economical air/fuel ratio, the carburetor produces an over-rich fuel-air mixture in full load low-speed operation, which causes various drawbacks, such as power reduction, poor fuel economy, carbon contamination of spark plugs, etc..

SUMMARY OF THE INVENTION

The object of the present invention is to provide a means for modifying air/fuel ratio of fuel-air mixture produced by a carburetor only in high-load low speed operation without disturbing the desired air/fuel ratio in other load conditions so that the problems due to an over-rich fuel-air mixture in high-load low speed operation are avoided while ensuring the desired slightly richer fuel-air mixture condition in low and medium load operation.

In accordance with the present invention, in a diaphragm-type two barrel carburetor having primary and secondary bores including primary and secondary venturi portions respectively, primary and secondary main fuel nozzles provided in said primary and secondary venturi portions respectively, primary and secondary throttle valves provided in said primary and secondary bores respectively, primary and secondary throttle shafts supporting said primary and secondary throttle valves respectively, and a diaphragm means adapted to be actuated by substantially the venturi vacuum of said primary venturi portion so as to open said secondary throttle valve, the aforementioned object is accomplished by providing a kick-up device for said secondary throttle valve comprising a kick lever connected with said primary throttle shaft and having a cam portion, and a follower lever connected with said secondary throttle shaft and having a cam follower portion, said cam and cam follower portions being so designed that said secondary throttle valve begins to open when said primary throttle valve is opened beyond a predetermined opening, is gradually more opened as said primary throttle valve is more opened beyond said predetermined opening, and is finally opened up to a predetermined relatively small opening when said primary throttle valve is fully opened, said predetermined relatively small opening being so determined that the air flow caused by such opening of said secondary throttle valve through said secondary venturi portion causes no substantial delivery of fuel from said secondary main fuel nozzle.

By incorporating a kick-up device of the aforementioned structure in a diaphragm-type two barrel carburetor, in high-load low speed operation wherein the venturi vacuum in the primary venturi portion is too small to actuate the diaphragm means so as to open the secondary throttle valve, the secondary throttle valve is forcibly opened up to the aforementioned predetermined relatively small opening by the cam and the cam follower mechanism, whereby an air bypass flow is caused through the secondary bore, said bypass air flow precluding an over-rich fuel-air mixture generated in the primary bore system on the one hand while on the other hand lessening the over-richness of the fuel-air mixture itself generated in the primary bore system due to a reduction of fuel delivery from the primary main fuel nozzle caused by a reduction of air flow through the primary venturi portion corresponding to the aforesaid bypass flow of air through the secondary bore. As mentioned above, the opening of the secondary throttle valve accomplished by the cam and the cam follower mechanism in high load low speed operation without actuation of the diaphragm means must be such a relatively small opening which causes no substantial delivery of fuel from the secondary main fuel nozzle. In this case, the slow fuel supply system for the secondary bore should be throttled enough not to cause any substantial delivery of fuel therethrough, and indeed it is desirable that the secondary slow system should be omitted.

The cam and cam follower mechanism for opening the secondary throttle valve in accordance with opening of the primary throttle valve should preferably be designed in a manner so that the secondary throttle valve begins to open when the primary throttle valve is opened 30°–60° from the full closed position, is gradually more opened as the primary throttle valve is more opened beyond the abovementioned opening, and is finally opened up to 5°–10° from its full closed position when the primary throttle valve is fully opened.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
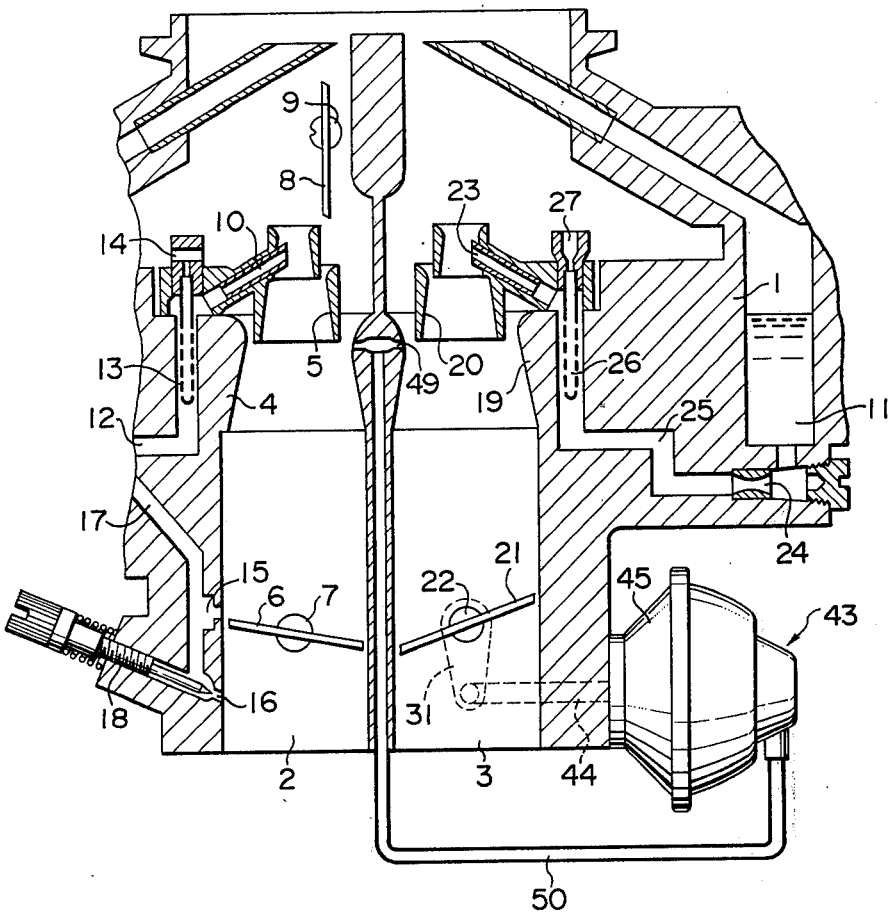
FIG. 1 is a partial sectional view of an example of a diaphragm-type two barrel carburetor suitable for incorporating the kick-up device for the secondary throttle valve of the present invention.

Referring to FIG. 1, 1 designates the body of a carburetor having a primary bore 2 and a secondary bore 3 arranged in parallel with each other. At a middle portion of the primary bore 2 is provided a primary large venturi 4, and in the throat portion of the primary large venturi is provided a primary small venturi 5. A primary throttle valve 6 is provided in the primary bore 2 at the downstream of the primary large venturi as supported by a primary throttle shaft 7 to be rotatable around the axis of the shaft. The primary bore 2 is further provided with a choke valve 8 as supported by a choke shaft 9 to be rotatable around the axis of the choke shaft at the upstream of the primary small venturi 5. A primary main fuel nozzle 10 is provided to open at the throat portion of the primary small venturi 5, said nozzle being adapted to be supplied with fuel from a float chamber 11 through a primary main fuel passage 12 under the metering action applied by a primary main jet (not shown) provided at a middle portion of the primary main fuel passage. The primary main fuel passage 12 also incorporates therein a primary well portion 13 connected with a primary main air bleed 14. The body 1 also has a slow port 15 which opens to the primary bore 2 at the position shown in FIG. 1 or, in more detail, a position located upstream of the primary throttle valve 6 when it is fully closed and located downstream of the throttle valve when it is slightly opened from its full closed position and an idle port 16 which opens to the primary bore 2 at a position downstream of the slow port 15 and also absolutely downstream of the primary throttle valve 6. The slow port 15 and the idle port 16 are adapted to be supplied with fuel through a slow fuel passage 17 branced from a middle portion of the primary main fuel passage 12. The flow of fuel through the slow fuel passage 17 is also metered by a slow jet and an economiser jet (neither shown) provided at middle portions of the slow fuel passage. Furthermore, the fuel delivery from the idle port 16 is further adjusted by a mixture adjust screw 18 independently from the fuel delivery rate from the slow port 15.

The secondary bore 3 is provided with a secondary large venturi 19 and a secondary small venturi 20, the latter being provided in the throat portion of the former. A secondary throttle valve 21 is also provided in the secondary bore 3 as supported by a secondary throttle shaft 22 to be rotatable around the axis of the shaft at the downstream side of the secondary large venturi 19. A secondary main fuel nozzle 23 is provided to open in the throat portion of the secondary small venturi 20 and is adapted to be supplied with fuel from the float chamber 11 through a secondary main fuel passage 25 under the metering action applied by a secondary main jet 24 provided at a middle portion of the secondary main fuel passage. A secondary well portion 26 is also provided at a middle portion of the secondary main passage 25 and is connected with a secondary main air bleed passage 27.

Figure 2:
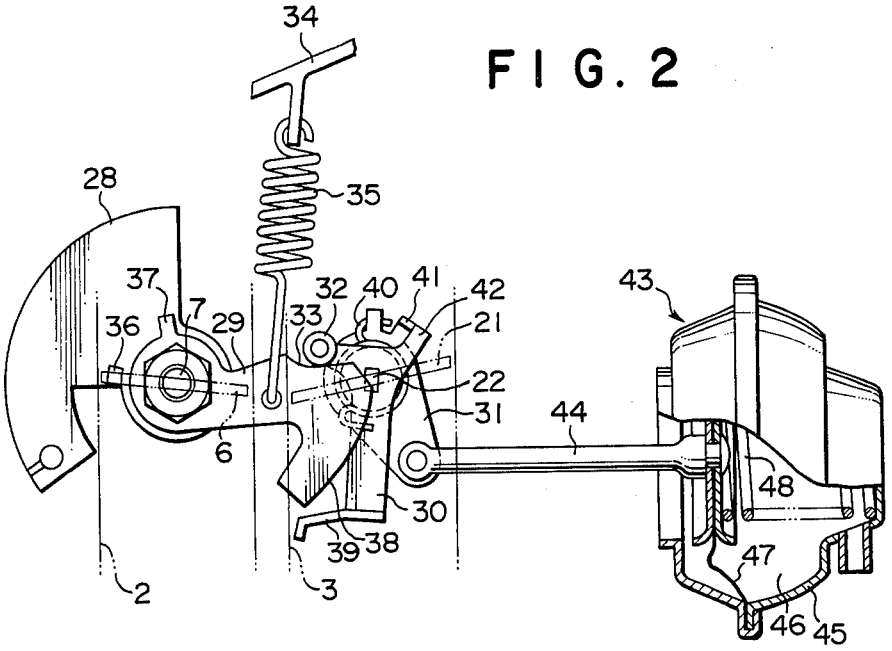
FIGS. 2 and 3 are views showing an embodiment of the kick-up device for the secondary throttle valve of the present invention in two operating conditions.
Figure 3:
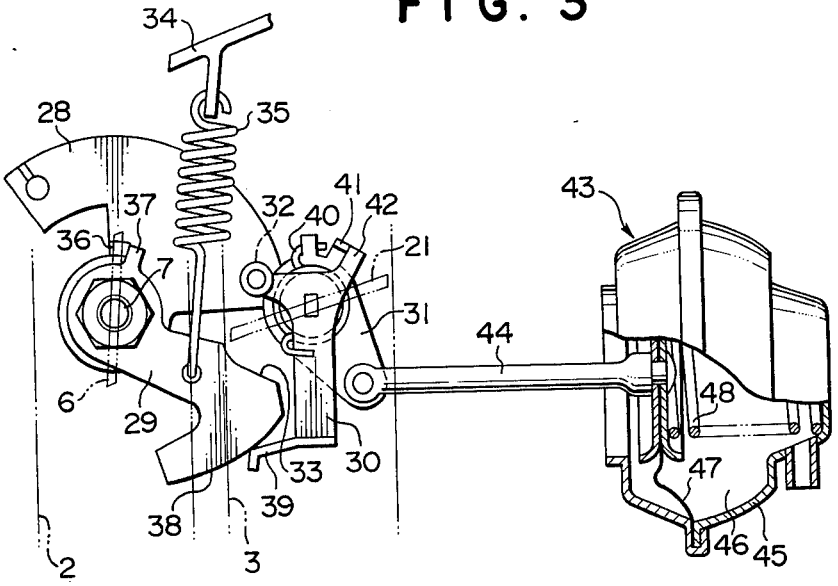

As shown in FIGS. 2 and 3, the primary throttle shaft 7 firmly supports by one end thereof a primary throttle lever 28 at one end thereof and also rotatably supports by the one end thereof a kick lever 29 at one end thereof. The primary throttle lever 28 is connected with an accelerator operating system including an accelerator pedal (not shown) and is operated to open the primary throttle valve 6 in accordance with the stepping-on operation of the accelerator pedal. The secondary throttle shaft 22 firmly supports by one end thereof a secondary throttle lever 30 at one end thereof and also rotatably supports by the one end thereof a relief lever 31 at one end thereof. The secondary throttle lever 30 has a stopper pin 32 at one end portion thereof, said stopper pin 32 being adapted to engage a stopper face 33 of the kick lever 29. A middle portion of the kick lever 29 is resiliently driven upward in the figure by an expansion coil spring 35 expanded between the middle portion of the kick lever and a hook 34 mounted to the body 1 so that the kick lever is resiliently driven anticlockwise around the axis of the primary throttle shaft 7, thereby maintaining the secondary throttle valve 21 at its fully closed position as shown in FIG. 2 until the primary throttle valve 6 is opened beyond a predetermined opening, i.e. so called "second touch opening". In more detail, the kick lever 29 has a peg 37 adapted to be engaged by a peg 36 on the primary throttle lever 28 when the latter lever rotates in the direction of opening the throttle valve or clockwise in the figure for, for example, 50° from the idle position as shown in FIG. 2, whereby when the primary throttle lever 28 rotates in the direction of opening the valve beyond the predetermined angle such as 50°, the kick lever 29 is rotated in the same direction, i.e. clockwise in the figure against the tensile force exerted by the coil spring 35 thereby allowing the secondary throttle lever 30 to rotate in the direction of opening the secondary throttle valve.

The kick lever 29 has a cam portion 38 at its free end while the secondary throttle lever 30 has a cam follower portion 39 at its free end, said cam portion being adapted to engage and drive the cam follower portion when the kick lever 29 is rotated clockwise as shown in FIG. 3. In the embodiment shown in FIGS. 2 and 3, the cam and cam follower mechanism is so designed that the cam portion 38 begins to engage the cam follower portion 39 when the primary throttle valve 6 is opened to the second touch opening and, thereafter, gradually drives the secondary throttle lever 30 anticlockwise in the figure as the primary throttle valve is more opened until the secondary throttle valve 21 is opened for a predetermined relatively small opening as shown in FIG. 3. The predetermined relatively small opening or the final kick-up angle of the secondary throttle valve is optionally determined by judiciously designing the contour of the cam portion 38 so as to satisfy the condition that when the primary throttle valve is fully opened in high load low speed operation, the air flow through the secondary bore is of a level which does not cause any substantial delivery of fuel from the secondary main fuel nozzle 23. In carburetors for normal automobile engines, it is desirable that the cam and the cam follower mechanism should be so designed that when the primary throttle valve 6 is fully opened, the secondary throttle valve 21 is opened to 5°–10° from its fully closed position.

A twist coil spring 40 is provided to act between the secondary throttle lever 30 and the relief lever 31 in a manner to drive the secondary throttle lever 30 anticlockwise in the figure while driving the relief lever 31 clockwise in the figure. The secondary throttle lever 30 and the relief lever 31 have mutually engagable pegs 42 and 41, respectively, thereby mutually limiting the aforementioned anticlockwise and clockwise rotations of the levers to the relative positions as shown in FIG. 3. The relief lever 31 has a free end connected with a diaphragm means 43 by a rod 44. The diaphragm means 43 is of a conventional type having a casing assembly 45 mounted to the body 1 of the carburetor and a diaphragm chamber 46 defined therein by a diaphragm 47. The diaphragm 47 is connected with the rod 44 and is biased leftward in the figure by a compression coil spring 48. As better shown in FIG. 1, the diaphragm chamber 46 is connected with a conventional venturi vacuum port 49 by a conduit means 50, said venturi vacuum port opening oppositely towards the throttle portions of the primary and secondary venturi portions 4 and 19 via throttling means.

In operation, when the primary throttle valve 6 is in the idling position as shown in FIGS. 1 and 2, the primary throttle lever 28, kick lever 29, secondary throttle lever 30, relief lever 31, diaphragm means 43 and its rod 44 are positioned as shown in FIG. 2, with the secondary throttle valve 21 being positioned at its fully closed position. Starting from this condition, when the primary throttle lever 38 is rotated clockwise in the figure by the accelerator operating system (not shown in the figure), the primary throttle valve 6 is opened from its idling position. In accordance with this opening of the primary throttle valve, the port which principally performs the supply of fuel changes from the idle port 16 to the primary main fuel nozzle 10 by way of the slow port 15. On the other hand, the secondary throttle valve 21 is maintained at its fully closed position until the primary throttle valve 6 is opened beyond the second touch opening where the peg 36 engages the peg 37 since the kick lever 29 is biased upward by the spring 35, thereby locking anticlockwise rotation of the secondary throttle lever 30 by the engagement of the stopper pin 32 and the stopper face 33, regardless of whether the venturi vacuum detected at the venturi vacuum port 49 is large enough to actuate the diaphragm means 43 to open the secondary throttle valve 21 or not in the medium speed operation of the engine. If venturi vacuum enough to bias the diaphragm 47 rightward in the figure is supplied to the diaphragm chamber 46, the relief lever 31 is rotated anticlockwise in the figure under the twisting of the spring 40 while leaving the secondary throttle lever 30 at the locked position as shown in FIG. 2.

When the primary throttle valve 6 is opened to the second touch opening, the peg 36 of the primary throttle lever 28 engages the peg 37 of the kick lever 29, and, when the primary throttle valve is further opened, the kick lever 29 is rotated together with the throttle lever 28 against the action of the expansion coil spring 35 thereby releasing the stopper pin 32 of the secondary throttle lever 30 from its engagement with the stopper face 33 of the kick lever 29. Thus, the secondary throttle valve 21 is now unlocked and is able to open if it is actuated by the diaphragm means 43. On the other hand, as the kick lever 29 rotates in accordance with opening operation of the primary throttle valve, the cam portion 38 engages the cam follower portion 39 and drives the secondary throttle lever 30 anticlockwise to open the secondary throttle valve to a relatively small opening as mentioned above. In this case, if the engine is operating in low speed condition so that the venturi vacuum supplied from the venturi vacuum port 49 to the diaphragm chamber 46 is not large enough to bias the diaphragm 47 against the action of the compression coil spring 48, the secondary throttle lever 30 is not rotated beyond the degree which is effected by the engagement of the cam portion 38 and the cam follower portion 39. If the primary throttle valve 6 is fully opened under this condition, the secondary throttle valve 21 is opened for a relatively small angle such as 5°–10° from its fully closed position. Due to such a small opening of the secondary throttle valve 21, a relatively small air flow is caused through the secondary bore 3 without inducing any substantial delivery of fuel from the secondary main fuel nozzle 23 thereby providing the effect of increasing the air/fuel ratio of the intake mixture in a manner of avoiding the over-richness troubles previously encountered in high load low speed operation. Therefore, the air/fuel ratio performance of the carburetor incorporating the present invention can be adjusted to provide a relatively rich fuel-air mixture in partial load condition without causing troubles in high load low speed operation.

Figure 4:
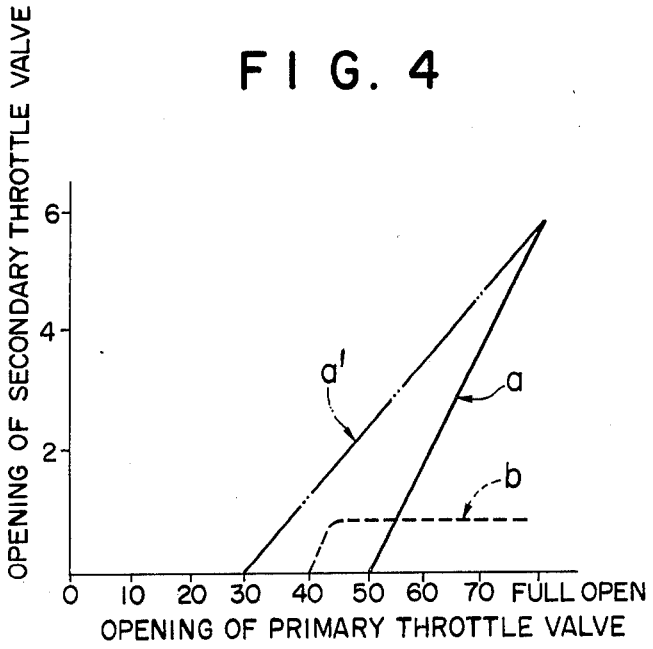
FIG. 4 is a graph showing the relations of the opening of secondary throttle valve to the opening of primary throttle valve.

In FIG. 4, relations of the secondary throttle opening to the primary throttle opening are shown for a conventional carburetor and carburetors incorporating the present invention. In the graph, solid line *a* and part-dotted line *a'* show the performance of the kick-up device of the present invention, whereas broken line *b* shows the performance of the conventional kick-up device. In accordance with the present invention, the secondary throttle opening gradually increases when the primary throttle opening increases so that it finally reaches 6° when the primary throttle valve is fully opened. By contrast, in the conventional kick-up device, the secondary throttle valve is opened for about 1° when the primary throttle opening reaches the second touch opening and thereafter the 1° opening is maintained regardless of the opening of the primary throttle valve. This is due to the reason that the only object of the conventional kick-up device is to prevent the secondary throttle valve from sticking to the bore wall by opening it slightly.

Figure 5:
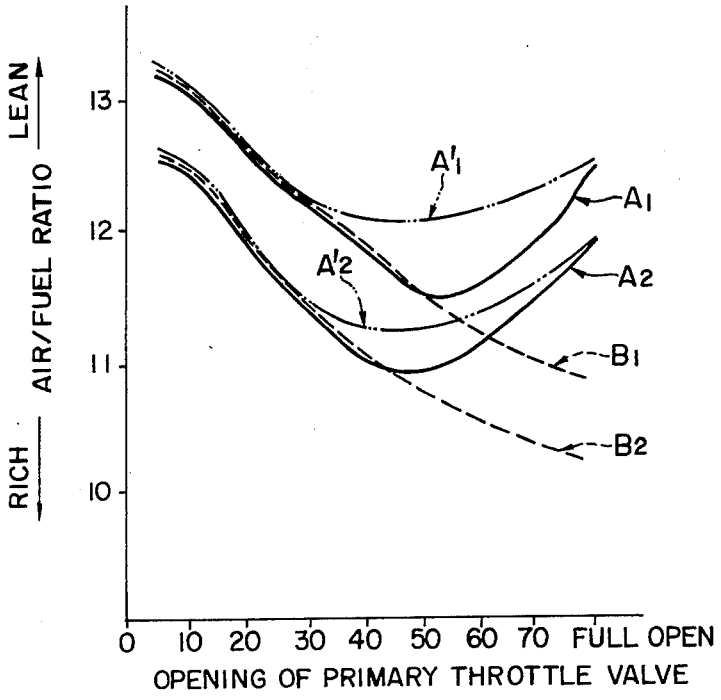
FIG. 5 is a graph showing the relations of air/fuel ratio to the opening of primary throttle valve.

FIG. 5 shows relations of the air/fuel ratio of fuel-air mixture to the primary throttle opening. In the graph, solid line A1, partly-dotted line A1' and broken line B1 show the air/fuel ratio performances at engine rotational speed 1,200 rpm while solid line A2, partly-dotted line A2', and broken line B2 show those at engine rotational speed 800 rpm. The solid lines A1 and A2 show the performance of a carburetor incorporating a kick-up device having a relation of secondary throttle opening to primary throttle opening as shown by the solid line a in FIG. 4. The partly-dotted lines A1' and A2' show the air/fuel ratio performances corresponding to the kick-up performance as shown by the partly-dotted line *a'* in FIG. 4. Finally, broken lines B1 and B2 show the air/fuel ratio performances obtained by a conventional kick-up device having a relation of secondary throttle opening to primary throttle opening as shown by the broken line *b* in FIG. 4. From the graph of FIG. 5, it will be understood that the over-richness troubles in high load low speed operation are effectively avoided by employing the kick-up device of the present invention.

When the engine is operating in medium load high speed condition with the primary throttle valve 6 opened beyond the second touch opening, the venturi vacuum supplied from the venturi vacuum port 49 to the diaphragm chamber 46 of the diaphragm means 43 will be large enough to bias the diaphragm 47 rightward in the figure thereby causing anticlockwise rotation of the relief lever 31 which then drives the secondary throttle lever 30 in the anticlockwise direction by way of the spring 40 until the stopper pin 32 engages the stopper face 33 of the kick lever 29 thereby opening the secondary throttle valve to the corresponding opening. When the primary throttle valve is fully opened, the stopper face 33 of the kick lever 29 is so positioned as to allow the secondary throttle valve to open to its full open position.

Figure 6:
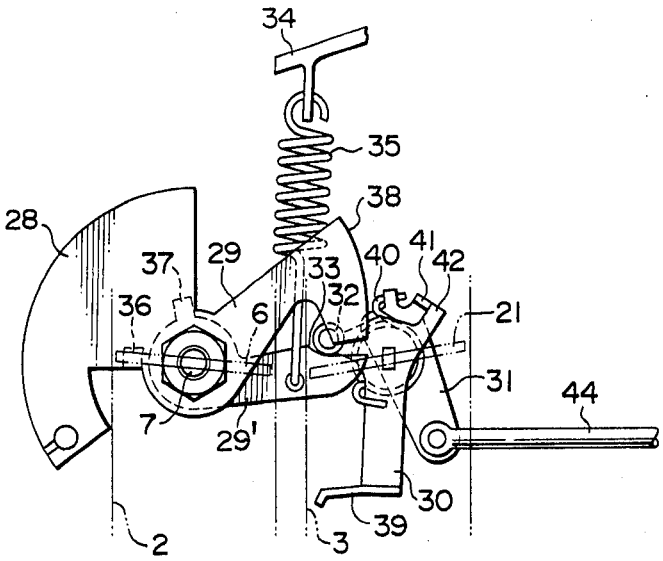
FIGS. 6 and 7 are views similar to FIGS. 2 and 3, showing another embodiment of the kick-up device of the present invention.
Figure 7:
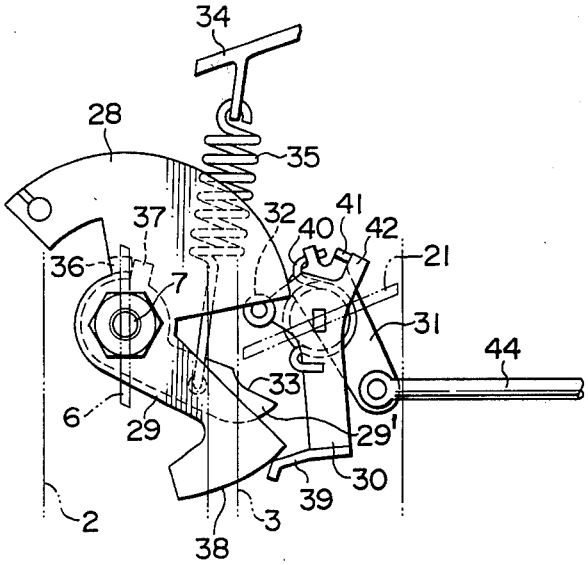

FIGS. 6 and 7 show another embodiment of the kick-up device of the present invention. In these figures, the portions corresponding to those shown in FIGS. 2 and 3 are designated by the same reference numbers. In this embodiment, the primary throttle lever 28 and the kick lever 29 are formed as parts of a unitary element firmly connected to the primary throttle shaft 7, while the stopper face 33 is provided by a stopper lever 29' rotatably supported by the primary throttle shaft 7 and having the peg 37 adapted to be engaged by the peg 36 provided in the aforesaid unitary element 28–29 for the primary throttle lever and the kick lever. The stopper lever 29' is biased upward by the expansion coil spring 35 in a manner similar to that in the first embodiment. It will be obvious that the embodiment shown in FIGS. 6 and 7 operates in substantially the same manner as the embodiment shown in FIGS. 2 and 3. Futhermore, this second embodiment having separate kick lever 29 and stopper lever 29' has an advantage that the timing for the second touch and that for the kick-up can be more readily independently adjusted.

Although the invention has been shown and described with respect to some preferred embodiments thereof, it should be understood by those skilled in the art that various changes and omissions of the form and detail thereof may be made therein without departing from the scope of the invention.

I claim:

1. In a diaphragm-type two barrel carburetor having primary and secondary bores including primary and secondary venturi portions respectively, primary and secondary main fuel nozzles provided in said primary and secondary venturi portions respectively, primary and secondary throttle valves provided in said primary and secondary bores respectively, primary and secondary throttle shafts supporting said primary and secondary throttle valves respectively, and a diaphragm means adapted to be actuated by substantially the venturi vacuum of said primary venturi portion so as to open said secondary throttle valve, a kick-up device for said secondary throttle valve comprising a kick lever connected with said primary throttle shaft and having a cam portion, a follower lever connected with said secondary throttle shaft and having a cam follower portion, said cam and cam follower portions being so designed that said secondary throttle valve begins to open when said primary throttle valve is opened beyond a predetermined opening, is gradually more opened as said primary throttle valve is more opened beyond said predetermined opening, and is finally opened up to a predetermined relatively small opening when said primary throttle valve is fully opened, said predetermined relatively small opening being so determined that the air flow caused by such opening of said secondary throttle valve through said secondary venturi portion causes no substantial delivery of fuel from said secondary main fuel nozzle.

2. The kick-up device of claim 1, wherein said cam and cam follower portions are so designed that said secondary throttle valve is opened for 5°–10° from its full closed position when said primary throttle valve is fully opened.

3. The kick-up device of claim 1, wherein said kick lever is driven by said primary throttle shaft by way of a lost motion mechanism so that said kick lever is driven by said primary throttle shaft when said primary throttle shaft rotates beyond the second touch opening, said kick lever having a stopper face for locking said secondary throttle valve at its full closed position until said primary throttle valve is opened beyond the second touch opening.

4. The kick-up device of claim 1, wherein said kick lever is firmly connected with said primary throttle shaft.

5. The kick-up device of claim 4, further comprising a stopper lever rotatably supported by said primary throttle shaft and adapted to be driven by said primary throttle shaft by way of a lost motion mechanism so that said stopper lever is driven by said primary throttle shaft when said primary throttle shaft is rotated beyond the second touch opening, said stopper lever having a stopper face for locking said second throttle valve at its fully closed position until said primary throttle shaft is opened beyond the second touch opening.

6. The kick-up device of claim 1, wherein said cam and cam follower portions are so designed that said secondary throttle valve begins to open when said primary throttle valve is opened beyond a predetermined opening in the range of 30°–50° from the full closed position.

* * * * *